United States Patent [19]

Negoro et al.

[11] Patent Number: 4,949,104

[45] Date of Patent: Aug. 14, 1990

[54] JUSTIFICATION SYSTEM FOR USE IN A PRINTER EMPLOYING A CONTINUOUS FORM

[75] Inventors: Ikuo Negoro, Sakado; Kiyoshi Negishi, Saitama; Masahiro Kita, Tokyo, all of Japan

[73] Assignee: Asahi Kogaku Kogyo K.K., Tokyo, Japan

[21] Appl. No.: 218,866

[22] Filed: Jul. 14, 1988

[30] Foreign Application Priority Data

Jul. 15, 1987 [JP] Japan ..... 62-108722[U]

[51] Int. Cl.[5] ..... G03G 15/00

[52] U.S. Cl. ..... 346/153.1; 355/316; 226/24; 226/74

[58] Field of Search ..... 355/308, 309, 316, 317; 226/24, 27, 28, 52, 55, 74–76; 346/153.1

[56] References Cited

U.S. PATENT DOCUMENTS 3,472,136 10/1969 Hemphill ..... 355/316 X
3,602,589 8/1971 Dietz ..... 355/317 X
3,790,270 2/1974 Donohue ..... 355/308

*Primary Examiner*—R. L. Moses
*Attorney, Agent, or Firm*—Sandler, Greenblum & Bernstein

[57] ABSTRACT

A justification system for use in a printer employing a continuous recording form. The justification system comprises a timing pulse signal generating system which generates timing pulses in synchronism with the traveling of sprocket holes of the continuous recording form. The timing pulses signals for commencing the printing on each printing segment defined on the continuous recording form and the timing for stopping the advancement of the continuous recording form are controlled based upon the above timing pulse signals. With this control, printing can be executed with a correct positional relationship with rules on each printing segment, even if the continuous recording form is set in the printer with a slight misalignment in the direction of the travel path of the continuous recording form or if the form itself has expanded or contracted in its longitudinal direction due to the effect of humidity.

13 Claims, 5 Drawing Sheets

JUSTIFICATION SYSTEM FOR USE IN A PRINTER EMPLOYING A CONTINUOUS FORM

BACKGROUND OF THE INVENTION

The present invention relates to a justification system for use in a printer employing a continuous form, and more particularly to a justification system for correcting undesirable displacement of a predetermined printing segment defined on a continuous form in its longitudinal direction.

Conventionally, there is known an image recording device that utilizes a so-called electrophotographic system in which a surface of a photoconductive drum is exposed to light to form a latent image on the drum surface. Toner is then applied to the latent image to develop the image, and the developed image is transferred onto a recording sheet material and fixed by a fixing unit. Such an image recording device is usually employed in a copying machine. In recent years, however, such image recording devices have been employed in printers and the like for printing the output from a computer.

In a copying machine, in general, cut sheets are used as the recording sheet materials. In a printer, however, it is desirable to use a continuous recording form as the recording medium. Such a form is identical with that used in a conventional line-printer. The continuous recording form is a folded continuous recording form (hereinafter referred to simply as "continuous form") called a fan-folded form which has sprocket holes formed along both side edge portions thereof. A perforation is provided at each of the folded sheet sections to define a printing segment between successive perforations and to enable the sheet sections to be easily separated from each other. Horizontal rules are marked at predetermined intervals in a longitudinal direction between the perforations with a predetermined positional relationship in respect to the sprocket holes.

However, in an electrophotographic printer a continuous form to which an unfixed toner image is applied is clamped and passed between a pair of rotating fixing rolls so that the toner image is fixed onto the continuous form. Accordingly the continuous form is usually driven by the rotation travel of the fixing rolls.

When the continuous form is transported by the fixing rolls, several problem might arise. For example, the continuous form that is clamped between the fixing roll can skew or meander because of various factors. If such skewing or meandering occurs, a defective fixing of the image and a defective transportion of the continuous form occurs. In view of such problems, an arrangement has been proposed, by the present assignee (see U.S. Ser. No. 177352 filed on 1st Apr., 1988), in which a direction-regulating feed mechanism is provided for a applying a tension to a portion of the continuous form that extends between the photoconductive drum and the fixing roll pair, so as to uniformize the state of the continuous form to be bitten into the nip between the pair of fixing rolls. With such a direction-regulating feed mechanism, it is possible to prevent skewing or meandering of the continuous form, and to automatically restore the continuous form to the regular position even if such skewing or meandering occurs.

In the printer employing the continuous form described above, there still remains another problem. Due to a misalignment between the continuous form and the direction-regulating feed mechanism caused when setting the former to the latter and/or to the expansion or contraction of the continuous form caused by humidity changes and so on, the associated area of circumferential surface of the photoconductive drum is shifted out of position with respect to the corresponding area of the continuous form. Thus, the printing position slips away from the rules on the continuous form. The continuous printing accumulates the displacements between the circumferential surface of the photoconductive drum and the continuous form with the result that the rules are meaningless. Also printing is executed on a non-printing area proximate each perforation on the continuous form which permits the form to be cut into separate sheets after printing.

SUMMARY OF THE INVENTION

Accordingly, if an object of the invention to provide a justification system that is capable of correcting an undesirable displacement of a predetermined printing segment defined on a continuous form in its longitudinal direction.

For the above purpose, according to the invention, there is provided a justification system for use in a printer employing a continuous form having a plurality of printing segments defined a longitudial direction thereof at predetermined intervals, comprising:

a rotary member that rotates in synchronism with the travel of the continuous form in the printer, means for detecting the travel of the continuous form based upon the rotation of the rotary member; and means for controlling, based upon the detection results of the detecting means, the the travel of the continuous form in case the printing is timing involved is executing a printing operation in case printing is to be executed on successive printing segments of the continuous form while the continuous form is continuously traveling, whereby printing is executed at substantially the same beginning in every printing segment, irrespective of the displacement of the printing segment in the longitudinal direction of the continuous form.

DESCRIPTION OF THE ACCOMPANYING DRAWINGS

DESCRIPTION OF THE EMBODIMENTS

Figure 1:
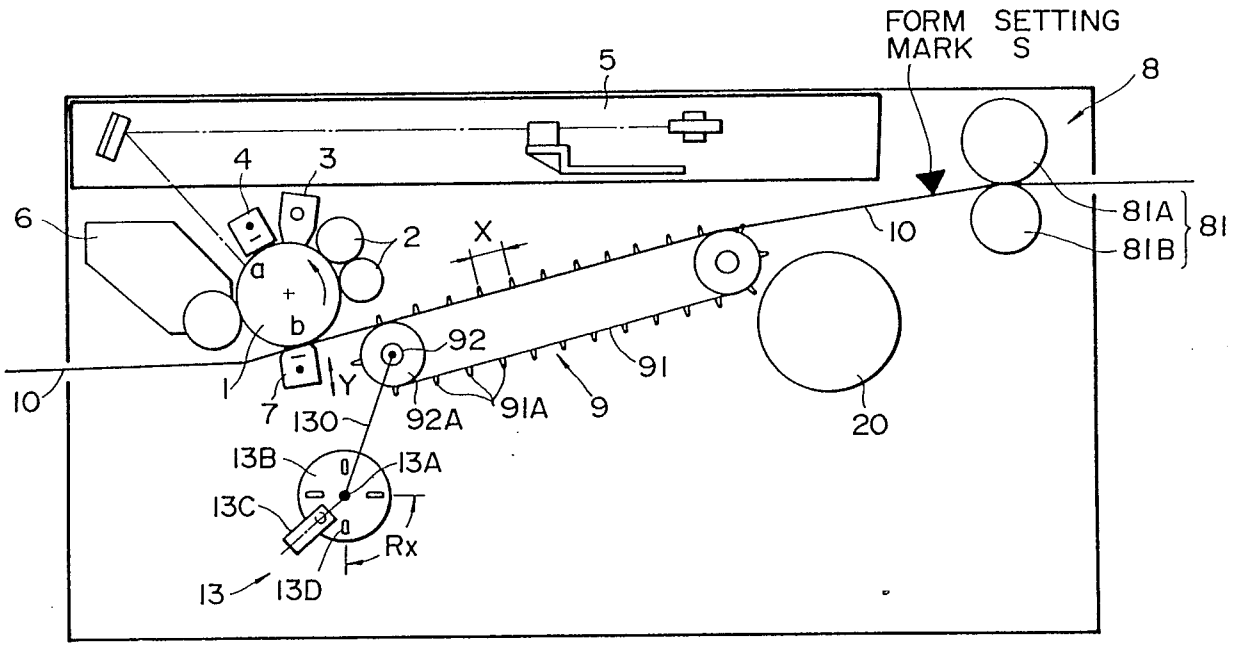
FIG. 1 is a diagramatic side view of a printer with a justification system embodying the invention.
Figure 2:
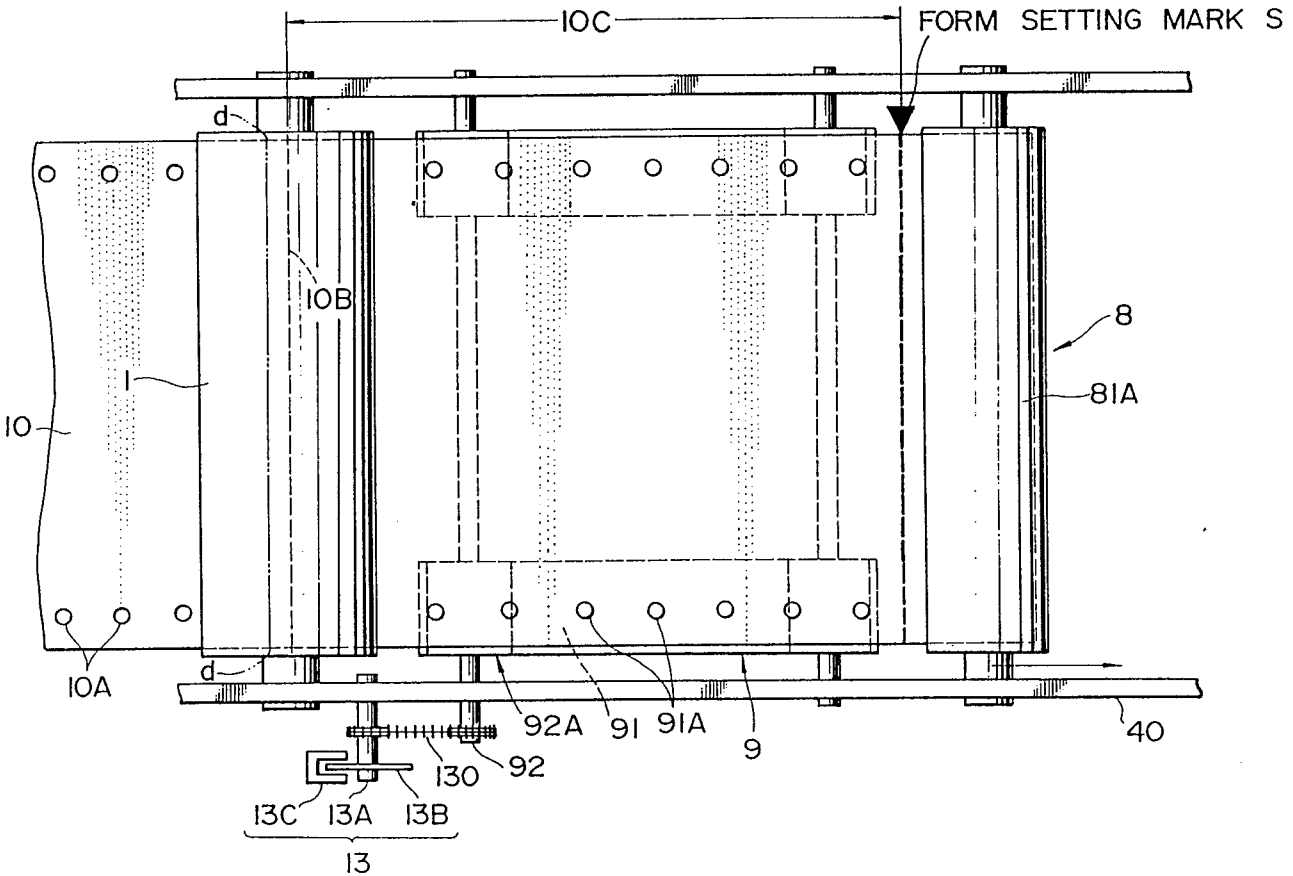
FIG. 2 is a plan view showing a continuous form being traveled inside the printer of FIG. 1.

Referring to FIGS. 1 and 2, there is illustrated a laser beam printer, in which a fan-folded form 10 is used as a continuous recording form, and in which a justification system embodying the present invention is incorporated.

Fan-folded form 10 is provided with sprocket holes 10A along both side edge portions thereof, and with perforations 10B at each folded section to define a printing segment 10C between the successive perforations 10B. Horizontal rules 10D are marked on each printing segment 10C with a predetermined positional relationship with respect to the sprocket holes 10A.

In this embodiment, sprocket holes 10A are arranged at an interval of every ½ inch and the rules 10D are arranged at an interval of every ⅓ inch. The perforatins 10B are formed after each twenty two (22) sprocket holes 10A.

The laser beam printer is designed to print information from a computer or the like, not shown, onto the fan-folded form 10 by means of an electrophotographic system. The laser beam printer comprises a photoconductive drum 1. Arranged about the photoconductive drum 1, in due order in a rotational direction thereof indicated by the arrow in FIG. 1, are a toner-cleaning station 2, a de-charging station 3, a charging station 4, an optical scanning system 5 for directing a modulated laser beam towards the photoconductive drum 1, a developing station 6, and a transferring station 7.

Fixing station 8 is arranged downstream of the photoconductive drum 1 with reference to the traveling direction in which the fan-folded form 10 travels along a predetermined path. A direction-regulating feed mechanism 9 is arranged in the predetermined path at a location between the photoconductive drum 1 and the fixing station 8. The arrangement is such that the laser beam from the optical scanning system 5 scans the charged surface of drum 1 along an axis thereof to carry out a main scanning, and drum 1 is rotated to carry out an auxiliary scanning, to thereby form a latent image on the charged drum surface. Toner is then applied at the developing station 6 to the latent image to develop the same. Subsequently, the developed toner image is transferred at the transferring station 7 onto the fan-folded form 10 which is driven by the mechanism of the fixing station 8 at a velocity that is identical with the peripheral speed of the photoconductive drum 1. The transferred toner image on the fan-folded form 10 is fixed at the fixing station 8. The fan-folded form 10, having carried thereon the fixed image, is then discharged out of the printer.

The transferring station 7 is arranged to be movable, as indicated by arrow Y in FIG. 1, in a direction perpendicular to a tangential direction of the drum surface between its advanced position and its retracted position. When the transferring station 7 is moved to its advanced position by a biasing force of a spring, not shown, form 10 is clamped between the drum surface and station 7, and the toner image on the drum surface is transferred onto the form 10. On the other hand, when transferring station 7 is moved to its retracted position by operating a solenoid, not shown, against the biasing force of the spring, enough spacing remains between the drum surface and station 7, for form 10 to freely pass therebetween.

At the fixing station 8, pair of fixing rolls 81 are arranged, which comprises an of upper and lower pressure roll, 81A and 81B, having their respective axes extending perpendicularly to the traveling direction of the fan-folded form 10. A gap, defined between the outer peripheral surfaces of the respective upper and lower pressure rolls 81A and 81B of the fixing roll pair 81, is set so that when the fan-folded form 10 is clamped between both pressure rolls 81A and 81B, the fan-folded form 10 is pressurized with a predetermined pressure.

The upper pressure roll 81A is drivingly connected to a DC (direct-current) motor 20 through a chain, not shown. The upper pressure roll 81A is rotatably driven by the motor 20 to clamp the fan-folded form 10, that carries thereon an unfixed image, between the upper and lower pressure rolls 81A and 81B.

The upper and lower pressure rolls 81A and 81B cooperate with each other to pressurize the fan-folded form 10 to fix the unfixed image thereon, thereby fixing the image onto the fan-folded form 10. The upper and lower pressure rolls 81A and 81B also cooperate with each other to drive the fan-folded form 10 to travel along the predetermined path, to discharge the fan-folded form 10 that carries thereon the fixed image out of the printer.

The peripheral speed of the photoconductive drum 1 and that of the fixing roll pair 81 are set to be coincident with each other. Accordingly, the peripheral speed of the drum 1 coincides with the travel speed of the fan-folded form 10. The DC motor 20 is used as a driving source for the photoconductive drum 1, as well as for the fixing roll pair 81. Accordingly, the traveling of the fan-folded form 10 can be regulated by controlling the driving of the DC motor 20.

A heat-roll fixing system may of course be employed instead of above fixing roll pair 81.

The direction-regulating feed mechanism 9 comprises a pair of endless tension belts 91 and 91 which are arranged, respectively, below the opposite side edge portions of the fan-folded form 10 to followingly travel from the transferring station 7 towards the fixing station 8 along the predetermined path when the form 10 is driven to travel. The tension belts 91 and 91 extend parallel to the traveling direction.

Tension belt 91 is provided on an outer peripheral surface with a plurality of projections 91A which are arranged in a single row along the entire periphery of the tension belt 91. The projections 91A on each tension belt 91 are spaced from each other at intervals of ½ inch, which is equal to that of the sprocket holes 10A formed along each side edge of the fan-falded form 10, so that the projections 91A are engageable with the sprocket holes 10A, as shown in FIG. 2.

The tension belt 91 regulates the traveling direction of the fan-folded form 10 to avoid an any undesired traveling, such as skewing or meandering, by applying tension to the fan-folded form 10. Further, with this tension application, any undesired traveling is automatically restored to normal.

Shaft 92 of the direction-regulating feed mechanism 9, arranged on the side of the photoconductive drum 1, is mounted on chassis 40 through a damper, not shown, in such a fashion that shaft 92 can rotate relative to chassis 40 with a certain circumferential resistance therebetween. Pulley 92A is fixedly mounted on shaft 92 to be rotated therewith. Thus, the circumferential resistance is applied through shaft 92 and pulley 92A to the tension belts 91 and 91 when they are rotated.

A detecting signal generating mechanism 13 is provided for generating a pulse signal each time a predetermined printing area on the printing segment of the fan-folded form 10 passes over a certain point in the travel path thereof.

Mechanism 13 comprises a shaft 13A, a disc plate 13B fixedly mounted on shaft 13A to be rotated therewith, and a so-called transmissive-type pulse-generator (hereinafter referred to simply as a "photosensor") 13C.

Shaft 13A is rotatally supported by chassis 40 and is coupled to the above-described shaft 92 through a timing belt 130 to be synchronously rotated therewith. Disc plate 13B is provided with four apertures 13D, each radially extending from the rotary center of the plate 13B. The circumferential length of pulley 92A is set to be four times the distance X between the adjacent sprockets 91A of the tension belt 91. Accordingly, disc plate 13A rotates 90 degrees (equal to arc Rx, shown in FIG. 1) upon the movement of the tension belt 91 by the distance X.

The photosensor 13C comprises a light source and light receiving element. The light source and the light receiving element are opposedly arranged to form therebetween a spacing for partly receiving the disc plate 13B therein so that it interrupts the passage of light emitted from the light source toward the light receiving element, and allowing the passing of light only when one of the apertures 13D passes between the light source and the light receiving element.

It should be noted that it is unnecessry to set the circumferential length of the pulley 92A to be four times the distance of X, if shaft 92 and shaft 13A is so coupled by timing belt 130 that the disc plate 13B rotates 90 degrees each time the pulley 92A rotates to move tension belt 91 the distance X.

As apparent from the above descriptions, photosensor 13C can detect the passage of each aperture 13D, and a pulse signal (PFS) is generated by photosensor 13C each time upon detecting the aperture 130. This means that the pulse signal PFS is generated by the photosensor 13C every time the fan-folded form 10 is moved by the distance X. In other words, every time one of the sprocket holes 10A of the form 10 passes the certain point in the travel path thereof. It can be further said that, since the sprocket holes 10A are provided on the fan-folded form 10 with the positional relationship to the rules 10D marked thereon, the above pulse signals PFS simultaneously function as the datum for detecting the rules 10D.

Setting mark S is provided at the position illustrated in FIGS. 1 and 2 for indicating the position at which the tip of the printing segment of the fan-folded form 10 is put when setting the form 10 onto the direction-regulating feed mechanism 9. The fan-folded form 10 is seated onto the direction-regulating feed mechanism 9 in such a fashion that one of the perforations on the fan-folded form 10 is positioned along the line indicated by the setting mark S.

Figure 3:
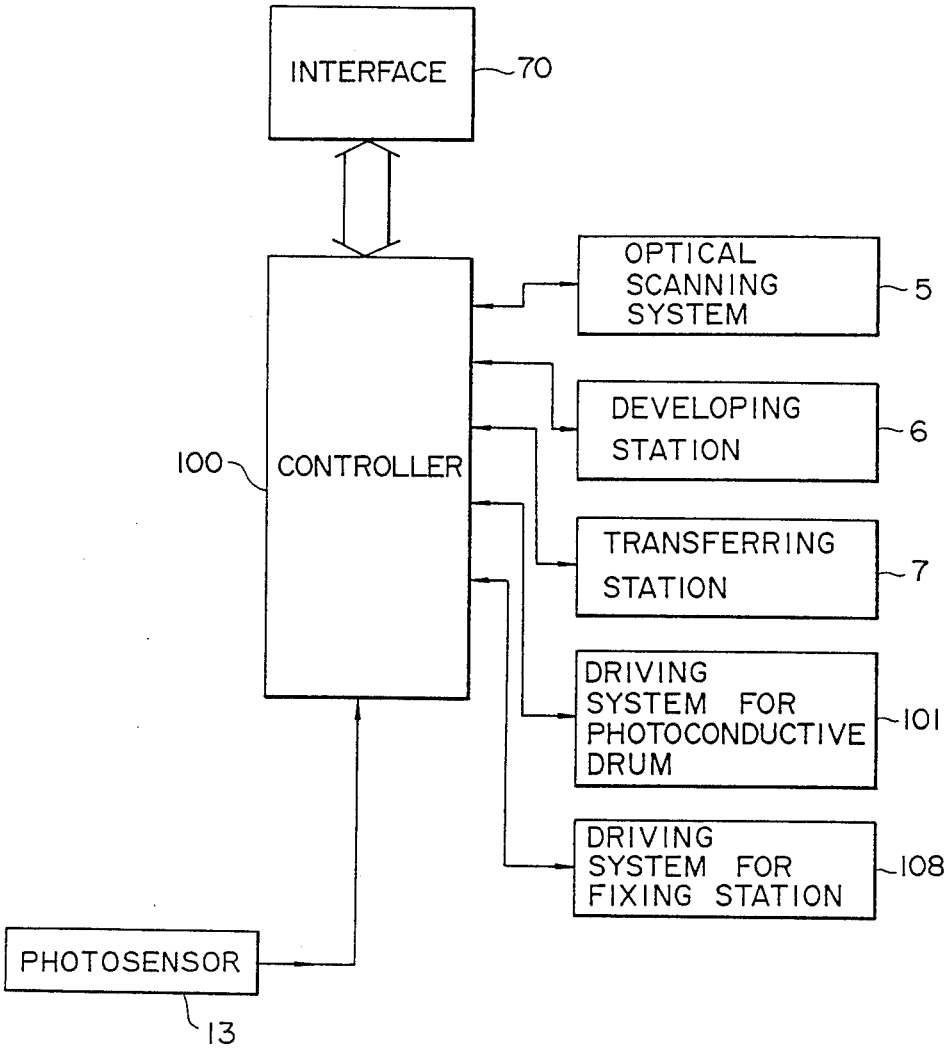
FIG. 3 is a block diagram of the justification system installed in the printer of FIG. 1.

FIG. 3 illustrates a block diagram of a control system for the above described laser beam printer.

Printing information is inputted to a controller 100 through an interface 70 from, for instance, a host computer, not shown. The controller 100 controls the operation of the printer, based upon the inputted printing information and the detecting signal PFS generated by the detecting signal generating mechanism 13, the optical scanning system 5, the developing station 6, the transferring station 7, a driving system 101 for the photoconductive drum 1, a driving system 108 for the fixing station 8 and so on.

Figure 4:
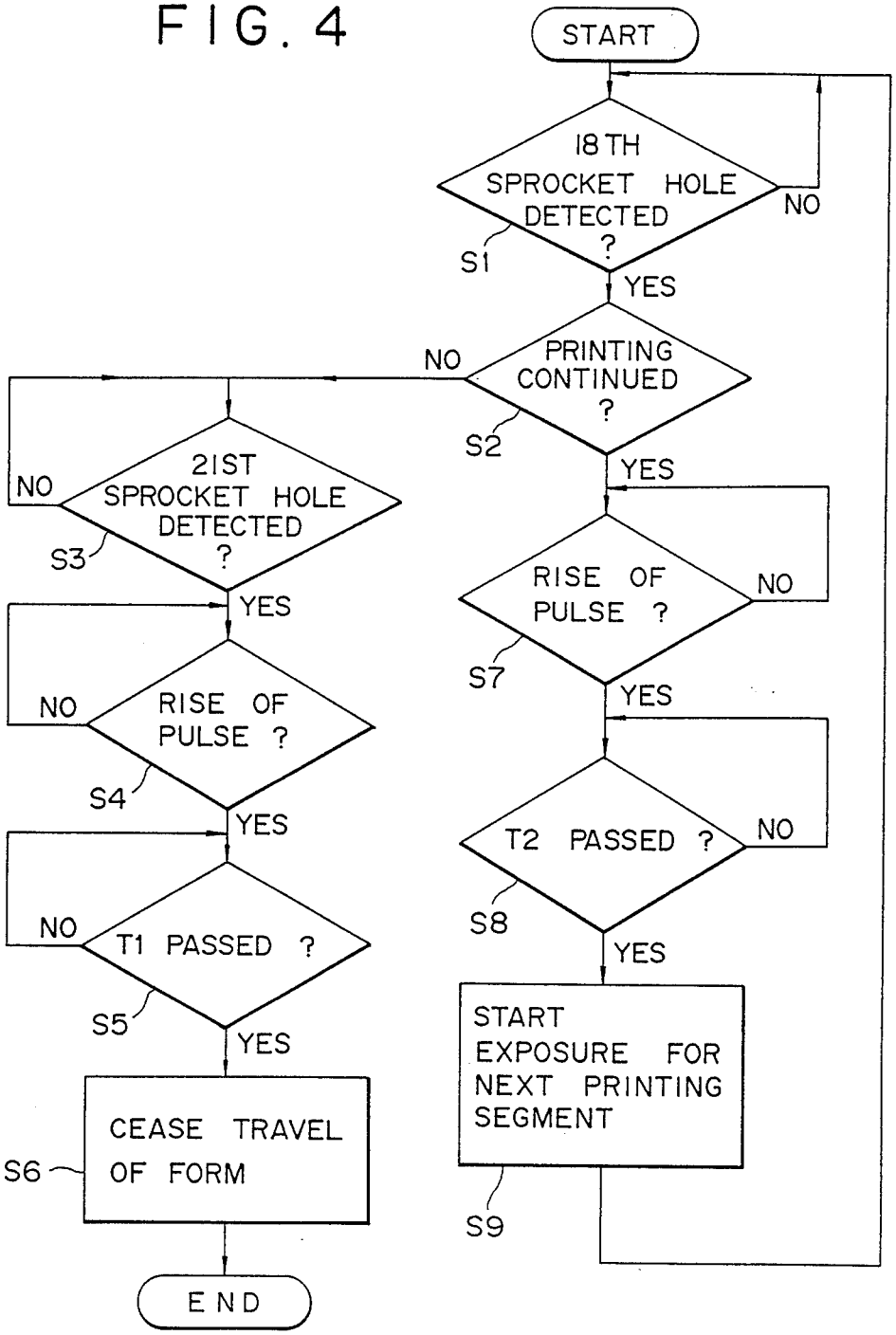
FIG. 4 is a flow chart of the justification system illustrated in FIG. 3.
Figure 5:
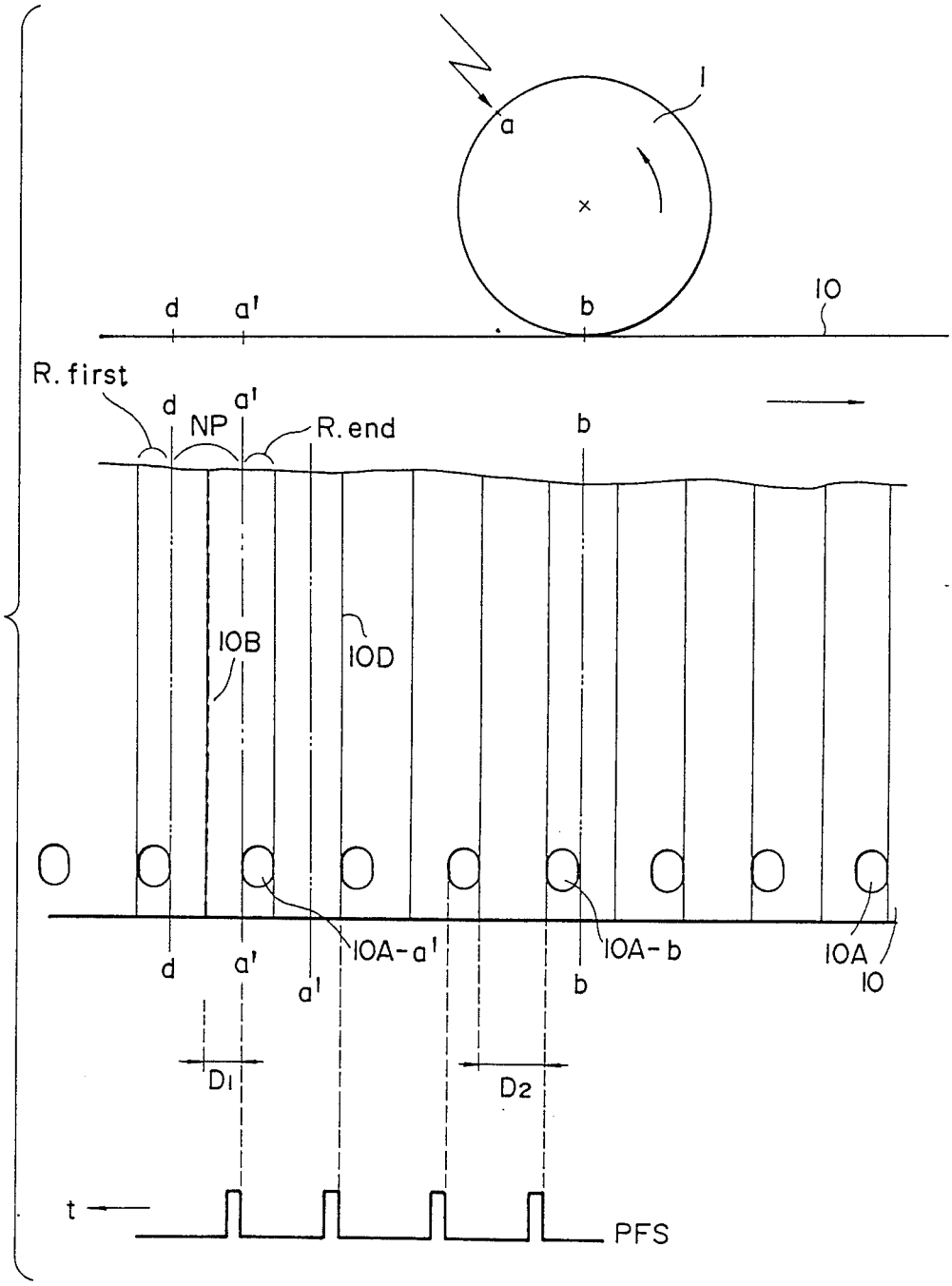
FIG. 5 is an explanatory view showing the positional relationship between a photoconductive drum and the continuous form.

FIG. 4 illustrates a flow-chart of a control program executed by the controller 100, and FIG. 5 illustrates the relationship between the pulse signals PFS generated by the photosensor 13C, the sprocket holes 10A and/or the rules 10D of the fan-folded form 10, and the photoconductive drum 1.

As illustrated in FIG. 5, the latent image formed on the photoconductive drum 1 at a beam scanning line a is transferred onto the fan-folded form 10 at a contact line b as the developed toner image. This means that the image just scanned at the beam-scanning line a is printed on a line a'—a' on the fan-folded form 10, which is away from a contact line b'—b' in the longitudinal direction by a distance equal to the circumferential distance between lines a and b on the photoconductive drum 1.

At the stage illustrated in FIG. 5, the photoconductive drum 1 has just been scanned by the beam carrying the image information corresponding to a last row Rend of the printing segement 10C, and the line a'—a' therefore corresponds to the last row of the printing segment 10C. In this embodiment, two printing rows are provided between adjacent rules 10D. Area NP, between the line a'—a' and line d—d, is a preset non-printing area.

The flow-chart of FIG. 4 is hereinbelow explained in conjunction with FIG. 5. Although not illustrated, it should be noted that controller 100 usually counts the number of pulses-PFS inputted thereinto from the photosensor 13C.

Controller 100 primarily discriminates whether the eighteenth pulse signal PFS has been counted. (Step S1).

Then it is determined, by checking the stored printing imformation, whether the printing continue to the next printing segment or whether it is finished (Step S2).

If the result at step S2 is NO (printing is to be finished), it is determined whether the twenty-first pulse signal PFS has been counted (Step S3).

Then, the output the photosensor 13c is monitored to detect the rise of the pulse signal PFS 13C Step S4. After time T1 passes (Step S5) from the detection of the rise of the pulse signal at step S4, the traveling of the fan-folded form 10 is terminated (Step S6). The time T1 is by subtracting the time required for terminating the traveling of the fan-folded form 10 from the time required for traveling of the fan-folded form 10 at a distance D1 between the rear edge of the twenty-second sprocket hole 10A-*a* and the perforation 10B.

With the description, the fan-folded form 10 stops in such a fashion that perforation 10B is positioned just below the contact line b of drum 1.

On the other hand, in case it is determined at step S2 that printing is to continue to a next printing segment, the output of photosensor 13c is monitored to detect the rise of the pulse signal PFS (Step S7). Then, after time T2 passes (Step S8) from the detection of the rise of the pulse signal PFS at step S7, the exposure with the laser beam, which carries the image information to be printed on the next printing segment, onto the photoconductive drum 1 is commenced (Step S9). Time T2 is the time required for the traveling of the fan-folded form 10 a distance D2 between the rear edge of the nineteenth sprocket hole 10A-*b* and the front edge of the successive sprocket hole.

Distance D2 is equal to the distance between the rear edge of the last sprocket hole 10A-*a'* and the first row R. first of the next printing segment. This means that the toner image is always correctly transferred onto the first row R. first of the next segment when the printing is executed over a single printing segment.

According to the control described above, when the traveling of the fan-folded form 10 stops, perforation line 10B on the fan-folded form 10 is always correctly positioned on the contact line b—b. Even if the fan-folded form 10 expands or contracts due to humidity, the output signal PFS of the photosensor 13C represents the travel of the actual sprocket hole on the expanded or contracted form 10. Thus, any difference caused by the expansion or the contraction can be cancelled. Further, if the fan-folded form 10 is not correctly set on the direction-regulating feed mechanism 9, i.e., if the tip of the form 10 is erronously set out of the form setting mark S, the error does not at all affect the synchronized relationship between the sprocket holes 91A and the output signal PFS of the photosensor 13c. Accordingly, printing is commenced at the predetermined position (equal to the first row R. first) on the successive printing segments.

What is claimed is:

1. A justification system for use in a printer employing a continuous form having a plurality of printing segments, comprising:

a plurality of indicators provided on each of said printing segments, said indicators being arranged in a longitudinal direction thereof at predetermined intervals;

means for detecting said indicators as said continuous form advances along a travel path; and means for controlling, in response to said detecting means, a timing signal for stopping the advancement of said continuous form along said travel path when a printing operation is finished, and for advancing said continuous form along said travel path when successive printing segments are to be executed, the beginning of each printing operation substantially starting at a beginning printing segment, irrespective of the displacement of said printing segment along the longitudinal direction of said continuous form, wherein said indicators comprise a plurality of sprocket holes provided along both edge portions of said continous form at predetermined intervals in the longitudinal direction thereof, and said detecting means comprises a rotary member provided with at least two apertures, each aperture extending in a radial direction from the center of said rotary member at an interval that corresponds to said predetermined interval of said sprocket holes in said continuous form, whereby said detecting means detects the passing of said sprocket holes at a certain point of said travel path of said continuous form.

2. The justification system according to claim 1, wherein said continuous form is provided with rules at predetermined intervals along said continuous form with a positional relationship with respect to said sprocket holes, whereby said detecting means detects the passing of said rules at said certain point of said travel path of said continuous form.

3. The justification system according to claim 1, wherein said control means obtains each timing signal upon the detection of said sprocket hole of the predetermined turning on said printing segment.

4. The justification system according to claim 3, wherein said control means stops the advancement of said continuous form when said printing operation is finished, based upon the detection of a predetermined sprocket hole which corresponds to a last printing row of said printing segment.

5. The justification system according to claim 3, wherein said printer employs a photoconductive member upon which a latent image is preliminarily formed to be developed and transferred onto said continuous form as a toner image, and wherein said control means initiates the forming of said latent image to be transferred to a following printing segment when said printing is to continue, based upon the detection of said sprocket hole which corresponds to the distance of travel of said continuous form between the forming of said latent image and the transferring of said toner image.

6. The justification system according to claim 3, wherein said printer employs an endless belt having a plurality of sprockets formed on an outer surface thereof that engages with said sprocket holes of said continuous form, said endless belt being advanced with the advancement of said continuous form, and a pair of pulleys between which said endless belt is extended, and wherein said justification system further comprises a timing belt which couples one of said pulleys and said rotary member to transmit a rotary motion of the former to the latter, said rotary member being rotated in synchronism with the travel of said continuous member.

7. The justification system according to claim 6, wherein the circumferential length of each of said pulleys is selected to be equal to a predetermined number of times of the distance between adjacent sprocket holes, and wherein said rotary member is provided with apertures that correspond to said predetermined number.

8. A printer for performing a printing operation in which information is printed onto a continuous form having a plurality of printing segments, each of said printing segments having at least one indicator, said printer utilizing an electrophotographic process to charge the surface of a photographic member by exposing it to an optical image at an exposure position to form a latent image thereon, said photoconductive member being circulatory moved in a predetermined area within said printer, toner being applied to said latent image so as to develop a visible image, said developed image being transferred onto said continuous form that is advanced in said printer in synchronism with the circulatory movement of said photoconductive member at a transferring station of said printer, and said transferred developed image being fixed at a fixing station in said printer, said printer comprising:

means for detecting a passing of said indicator at a predetermined position on said circulatory path of said photoconductive member;

means for determining whether said printing operation is to continue to a successive printing segment; and means for successively exposing said photoconductive member to form a further latent image corresponding to said successive printing segment, when a predetermined period has elapsed since the passing of said indicator has been detected, after it is determined by said determining means that said printing operation is to continue.

9. The printer of claim 8, wherein said optical image comprises a laser beam that is modulated in accordance with an image to be printed.

10. The printer of claim 8, further comprising means for setting a leading end of one of said printing segments of said continuous form at said transferring station.

11. A printer for performing a printing operation in which information is printed onto a continuous form having a plurality of printing segments, each of said printing segments having at least one indicator, said printer utilizing an electrophotographic process to charge the surface of a photographic member by exposing it to an optical image at an exposure position to form a latent image thereon, said photoconductive member being circulatory moved in a predetermined area within said printer, toner being applied to said latent image so as to develop a visible image, said developed image being transferred onto said continuous form that is advanced in said printer in synchronism with the circulatory movement of said photoconductive member at a transferring station of said printer, and said transferred developed image being fixed at a fixing station in said printer, said printer comprising:

means for detecting a passing of said indicator at a predetermined position on said circulatory path of said photoconductive member;

first means for determining whether said printing operation is to continue to a successive printing segment;

second means for determining whether said image transfer has been completed; and means for stopping the advancement of said continuous form when a predetermined period has elapsed since said indicator has been detected when said second determining means determines that said transferring operation is to be terminated.

12. The printer of claim 11, wherein said optical image comprises a laser beam that is modulated in accordance with an image to be printed.

13. The printer of claim 11, further comprising means for setting a leading end of one of said printing segments of said continuous form at said transferring station.

* * * * *